US007050033B2

(12) United States Patent
Chiu

(10) Patent No.: US 7,050,033 B2
(45) Date of Patent: May 23, 2006

(54) LOW POWER SOURCE DRIVER FOR LIQUID CRYSTAL DISPLAY

(75) Inventor: Ming Cheng Chiu, Tainan (TW)

(73) Assignee: Himax Technologies, Inc., Tainan (TW)

( * ) Notice: Subject to any disclaimer, the term of this patent is extended or adjusted under 35 U.S.C. 154(b) by 477 days.

(21) Appl. No.: 10/602,587

(22) Filed: Jun. 25, 2003

(65) Prior Publication Data

US 2004/0263464 A1 Dec. 30, 2004

(51) Int. Cl.
*G09G 3/36* (2006.01)

(52) U.S. Cl. ..... 345/98; 345/100

(58) Field of Classification Search ..... 345/98, 345/100, 87–89, 211–213, 204–205
See application file for complete search history.

(56) References Cited

U.S. PATENT DOCUMENTS 6,075,524 A 6/2000 Ruta
6,127,997 A 10/2000 Tsuchi
6,351,163 B1 * 2/2002 Yoshizawa et al. ..... 327/142
6,664,943 B1 * 12/2003 Nakajima et al. ..... 345/98

OTHER PUBLICATIONS

Saito et al.; "17.3: A 6-Bit Digital Data Driver for Color TFT-LCDs"; SID 95 Digest, pp. 257-258, (1995).

* cited by examiner

*Primary Examiner*—Xiao Wu
(74) *Attorney, Agent, or Firm*—Finnegan, Henderson, Farabow, Garrett & Dunner, L.L.P.

(57) ABSTRACT

Disclosed is a source driver for receiving an input voltage and generating an output voltage to drive a data line in a liquid crystal display apparatus. In the source driver, first and second P-channel MOS transistors are together used as a primary source follower to trace the input voltage thereby eliminating the body effect and keeping the loading charge loss constant. First and second N-channel MOS transistors are used, as a secondary source follower. A capacitor is used for boosting the voltage of the drain of the first N-channel MOS transistor on the level of at least the input voltage plus the threshold voltage of the N-channel MOS transistor. In addition, an extra switch is used to reach the accurate output voltage when the output voltage is approaching the input voltage.

20 Claims, 11 Drawing Sheets

| S1 | S2 | NP | S3(S7) | S4 | S5 | S6 | S8 |
|---|---|---|---|---|---|---|---|
| ON | ON | Low | OFF | OFF | OFF | OFF | OFF |
| OFF | OFF | High | ON | OFF | OFF | OFF | OFF |
| OFF | OFF | High | OFF | ON | OFF | ON | OFF |
| OFF | OFF | High | OFF | ON | ON | OFF | OFF |
| OFF | OFF | High | OFF | ON | OFF | OFF | ON |

FIG. 5

| S1 | S2 | NP | S3(S7) | S4 | S9 | S5 | S6 | S8 |
|---|---|---|---|---|---|---|---|---|
| ON | ON | Low | OFF | OFF | OFF | OFF | OFF | OFF |
| OFF | OFF | High | ON | OFF | OFF | OFF | OFF | OFF |
| OFF | OFF | High | OFF | OFF | ON | ON | OFF | OFF |
| OFF | OFF | High | OFF | OFF | ON | OFF | ON | OFF |
| OFF | OFF | High | OFF | OFF | OFF | OFF | OFF | ON |

FIG. 11

LOW POWER SOURCE DRIVER FOR LIQUID CRYSTAL DISPLAY

BACKGROUND OF THE INVENTION

1. Field of the Invention

The present invention relates to an apparatus for driving a liquid crystal display (LCD) apparatus, and more particularly, to a low power source driver for use in the LCD driving apparatus.

2. Description of the Related Art

Since LCD panels are thinner in size and lower in power dissipation as compared with cathode-ray tube (CRT) panels, the LCD panels have recently been applied to personal computers, word processors, color telereceivers. Particularly, since active matrix-type LCD apparatuses have a high-speed response, a fine screen with a high quality, and a multi-gradation display, the active matrix-type LCD apparatuses have been in demand.

Generally, an active matrix-type LCD apparatus is constructed by a semiconductor substrate having thin film metal wire, a transparent pixel electrodes and thin-film transistors (TFTs), a counter substrate having a transparent common electrode, and liquid crystal inserted between the semiconductor substrate and the counter substrate. A gradation voltage is applied to each pixel electrode by controlling the TFT with a switching function, and transmittance of the liquid crystal is changed by the difference in voltage between each pixel electrode and the common electrode to provide display on the screen.

Provided on the semiconductor substrate are data lines for applying gradation voltages to the pixel electrodes and scan lines for applying switching control signals (scan signals) to the TFTs. Then, when the, scan signal of the scan line is at a high level, all the TFTs connecting the scan line are turned ON, and the gradation voltages sent to the data line are applied to the pixel electrodes through the TFTs. When the scan signal becomes low to turn OFF the TFTs, the difference in voltage between each pixel electrode and the common electrode is maintained until the next gradation voltages are applied to the pixel electrodes. Thus, when scan signals are sequentially sent to each scan line, gradation voltages are applied to all the pixel electrodes, so that display on the screen is renewed at every frame period.

An LCD driving apparatus for driving the data lines is required to charge/discharge a large load of each data line including a liquid crystal capacitance, wiring resistances and wiring capacitance.

An LCD driving apparatus is generally constructed by a voltage divider, a decoder and driver connected to a data line. Conventionally, the driver is implemented by operational amplifier (see: S. Saito et al., "A 6-bit Digital Data Printer for Color TFT-LCDs", SID 95 Digest, pp. 257–260, 1995). Since the operational amplifier has a high current supplying capability, the driver can drive the data line having a large capacitance load at a high, speed. Additionally, even when the threshold voltages of transistors within the operational amplifier fluctuate slightly, the fluctuation of the output voltage of the operational amplifier is relatively small. In addition, the output voltage can be highly accurate.

In the prior art driver, however, the number of operational amplifiers with a large number of elements increases with the number of data lines. Therefore, if an LCD driving apparatus using the prior art driver is constructed in the form of a single integrated circuit device, the size of the integrated circuit device must be increased to accommodate enough operational amplifiers thereby increasing the manufacturing cost thereof. In addition, steady currents are required for the operational amplifiers, which increases the power dissipation. The structure is not suitable for use of low power loss. The detailed technology for employing the operational amplifier in an LCD driving apparatus can be found in U.S. Pat. No. 6,075,524, issued to Ruta, entitled "Integrated Analog Source Driver For Active Matrix Liquid Crystal Display". U.S. Pat. No. 6,127,997, issued to Tsuchi, entitled "Deriver For Liquid Crystal Display Apparatus With No Operational Amplifier" discloses another LCD driving apparatus which is constructed without the operational amplifier. However, there is still a problem of larger channel precharge charge loss since a large swing of charging or discharging operation is carried out in the structure.

SUMMARY OF THE INVENTION

It is an object of the present invention to provide a source driver for use in an LCD driving apparatus which is capable of reducing the manufacturing cost and the power dissipation, obtaining accurate source drive output and reducing loading charge loss.

The present invention provides a source driver for receiving an input voltage and generating an output voltage to drive a data line in a liquid crystal display apparatus. In the source driver of the present invention, first and second P-channel MOS transistors are used to trace the input voltage thereby eliminating the body effect in the n-well process and keeping the loading charge loss constant. The first and second P-channel MOS transistors have a common gate connected to a drain of the first P-channel MOS transistor wherein the second P-channel MOS transistor has a source connected to an output terminal. First and second N-channel MOS transistors have a common gate connected to a drain of the first N-channel MOS transistor, and the second N-channel MOS transistor has a source connected to the output terminal. A third N-channel MOS transistor has a gate connected to an input terminal, a source connected to the source of the first P-channel MOS transistor. A third P-channel MOS transistor has a source connected to the power supply terminal, a gate connected to a drain of the third P-channel MOS transistor. A first switch is connected between the drain of the third P-channel MOS transistor and the drain of the first N-channel MOS transistor. A second switch is connected between the ground terminal and the drain of the first P-channel MOS transistor. A third switch is connected between a power supply terminal and the drain of the third N-channel MOS transistor. A fourth switch is connected between the input terminal and a source of the first N-channel MOS transistor. A fifth switch is connected between the power supply terminal and a drain of the second N-channel MOS transistor. A sixth switch is connected between the ground terminal and a drain of the second P-channel MOS transistor. A first capacitor for receiving a control signal to boost the voltage of the drain of the first N-channel MOS transistor on the level of at least the input voltage plus the threshold voltage of the N-channel MOS transistor is connected between the ground and the drain of the first N-channel MOS transistor. According to one aspect of the present invention, the source driver further comprises a fourth P-channel MOS transistor and a seventh switch. The fourth P-channel MOS transistor has a gate connected to the input terminal and a source connected to the source of the first N-channel MOS transistor. The seventh switch is connected between the ground terminal and a drain of the fourth P-channel MOS transistor.

According to one aspect of the present invention, the source driver further comprises a ninth switch connected between the input terminal and a source of the third N-channel MOS transistor.

According to another aspect of the present invention, the source driver further comprises a fourth N-channel MOS transistor having a gate connected to a low voltage, a source connected to the drain of the second P-channel MOS transistor and a drain connected to the output terminal.

According to another aspect of the present invention, the source driver further comprises an eighth switch connected between the input terminal and the output terminal. The eighth switch is turned ON after operation of the second P-channel MOS transistor or the second N-channel MOS transistor as a source follower.

The LCD driving apparatus of the present invention constructed without the operational amplifier can significantly reduce the above problem of larger channel precharge charge loss.

BRIEF DESCRIPTION OF THE DRAWINGS

Other objects, advantages, and novel features of the invention will become more apparent from the following detailed description when taken in conjunction with the accompanying drawings.

FIG. 5 is a table showing the operation of the driver of FIG. 2;

FIG. 11 is a table showing the operation of the driver of FIG. 6.

DESCRIPTION OF THE PREFERRED EMBODIMENTS

Figure 1:
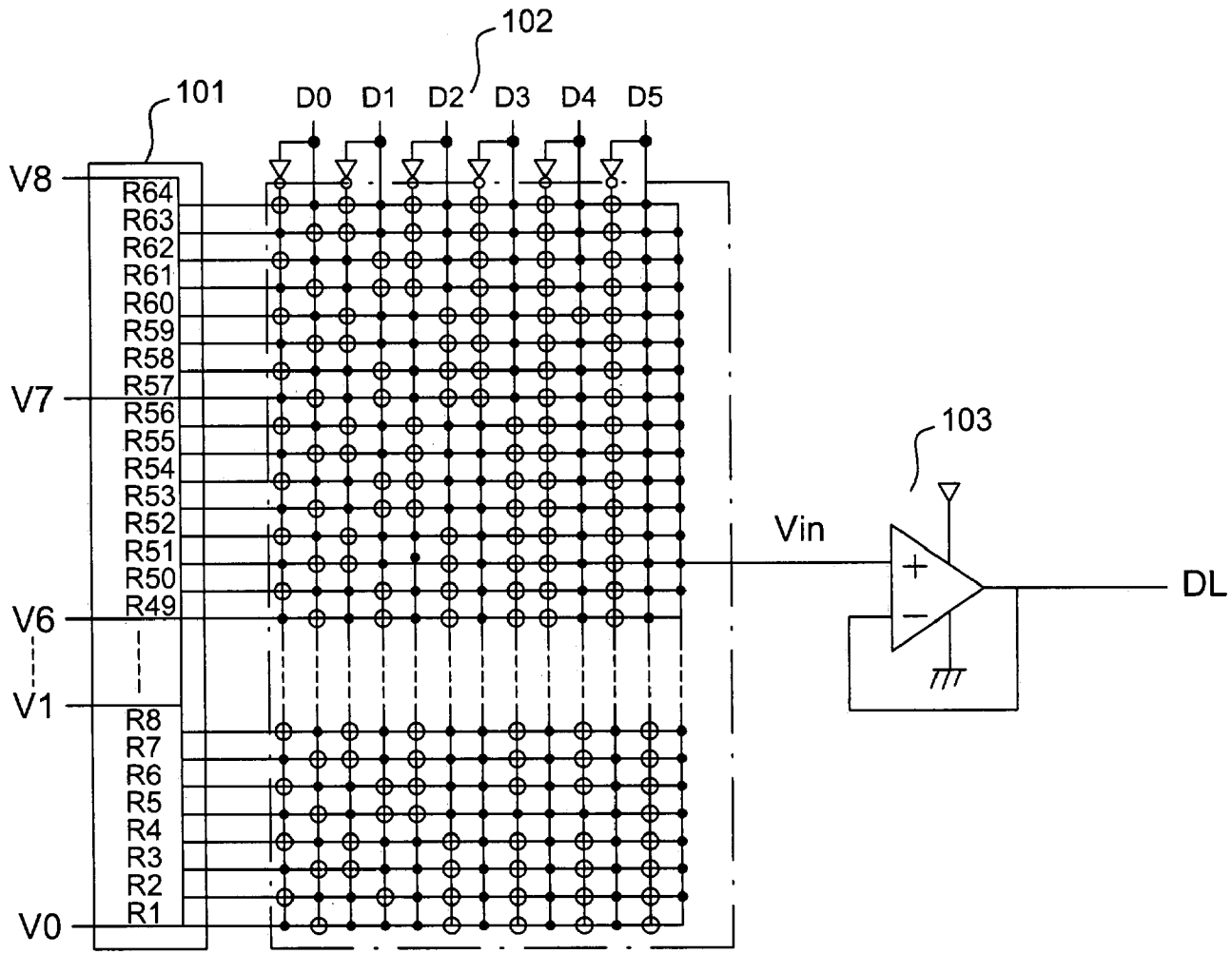
FIG. 1 (PRIOR ART)
FIG. 1 is a circuit diagram illustrating a prior art LCD driving apparatus.

Before the description of the preferred embodiments according to the present invention, a typical LCD driving apparatus will be explained with reference to FIG. 1. As shown, the LCD driving apparatus is generally constructed by a voltage divider 101, a decoder 102 and a driver 103 connected to a data line DL. The data line DL is also connected via TFTs (not shown) to pixel electrodes. The voltage divider 101 is formed by resistors R1, R2, . . . , R64 for generating multi-gradation voltages. Also, the decoder 102 is formed by CMOS switches provided at intersections between lines connected to the resistors R1, R2, . . . , R64 and lines for receiving video data signals D0, D1, . . . , D5.

Figure 2:
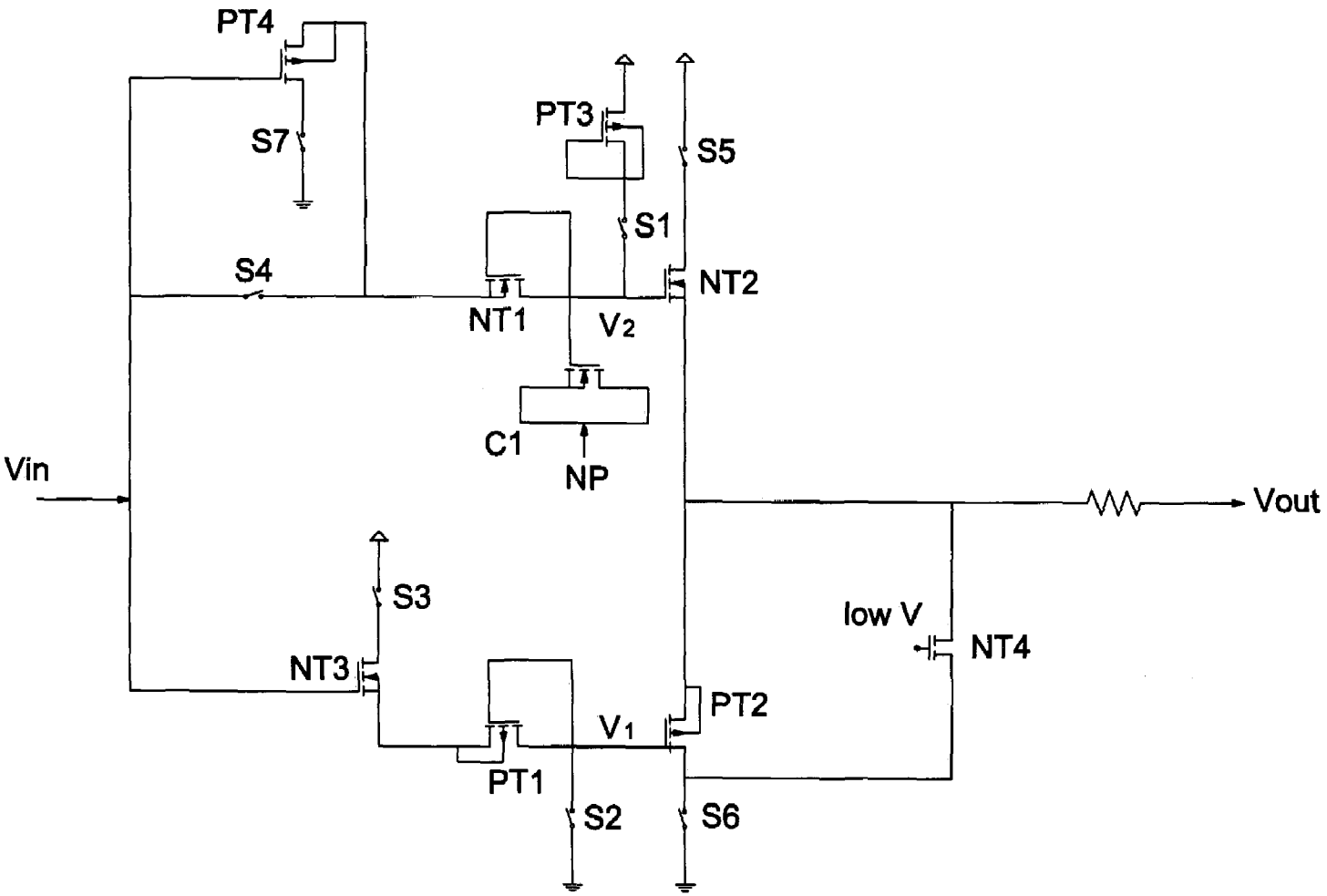
FIG. 2 is a circuit diagram illustrating a first embodiment of the driver according to the present invention.

FIG. 2 shows a source driver according to a first embodiment of the present invention. In the source driver of the present invention, first and second P-channel MOS transistors are used to trace the input voltage thereby eliminating the body effect in n-well process and keeping the loading charge loss constant. The first and second P-channel MOS transistors PT1, PT2 have a common gate connected to a drain of the first P-channel MOS transistor PT1, and the second P-channel MOS transistor PT2 has a source connected to an output terminal. First and second N-channel MOS transistors NT1, NT2 have a common gate connected to a drain of the first N-channel MOS transistor NT1, and the second N-channel MOS transistor NT2 has a source connected to the output terminal. A third N-channel MOS transistor NT3 has a gate connected to an input terminal, and a source connected to the source of the first P-channel MOS transistor PT1. A third P-channel MOS transistor PT3 has a drain connected to the power supply terminal, a gate connected to a source of the third P-channel MOS transistor PT3. A first switch S1 is connected between the source of the third P-channel MOS transistor PT3 and the drain of the first N-channel MOS transistor NT1. A second switch S2 is connected between the ground terminal and the drain of the first P-channel MOS transistor PT1. A third switch S3 is connected between a power supply terminal and a drain of the third N-channel MOS transistor NT3. A fourth switch S4 is connected between the input terminal and a source of the first N-channel MOS transistor NT1. A fifth switch S5 is connected between the power supply terminal and a drain of the second N-channel MOS transistor NT2. A sixth switch S6 is connected between the ground terminal and a drain of the second P-channel. MOS transistor PT2. A first capacitor C1 for receiving a control signal NP to boost the voltage of the drain of the first N-channel MOS transistor on the level of at least the input voltage plus the threshold voltage of the N-channel MOS transistor is connected between the control signal terminal and the drain of the first N-channel MOS transistor. A capacitor of any type (e.g., Metal-Insulator-Metal form or Air-gap form) can be used as the first capacitor C1.

The third N-channel MOS transistor NT3, the third and second switches S3, S2 are operated to bias a voltage at the gate of the second P-channel MOS transistor PT2 to a voltage shifted from the input voltage by a threshold voltage of the first P-channel MOS transistor PT1 plus a threshold voltage of the third N-channel MOS transistor NT3. The third P-channel MOS transistor PT3, and the fourth and first switches S4, S1 are operated to bias a voltage at the gate of the second N-channel MOS transistor NT2 to a voltage shifted from the input voltage by a threshold voltage of the first N-channel MOS transistor NT1. The sixth switch S6 is operated to operate the second P-channel MOS transistor PT2 as a source follower, so that a voltage shifted from a voltage at the common gate of the first and second P-channel MOS transistors PT1, PT2 by a threshold voltage of the second P-channel MOS transistor PT2 is output as the output voltage at the output terminal. The fifth switch S5 is operated to operate the second N-channel MOS transistor NT2 as a source follower, so that a voltage shifted from a voltage at the common gate of the first and second N-channel MOS transistors NT1, NT2 by a threshold voltage of the second N-channel MOS transistor NT2 is output as the output voltage at the output terminal.

In the source driver of the present invention, the source driver may further comprise a fourth P-channel MOS transistor PT4 and a seventh switch S7. The fourth P-channel MOS transistor PT4 has a gate connected to the input terminal and a source connected to the source of the first N-channel MOS transistor NT1. The seventh switch S7 is connected between the ground terminal and a drain of the fourth P-channel MOS transistor PT4. Furthermore, the source driver of the present invention may further comprise a fourth N-channel MOS transistor NT4 has a gate connected to a low voltage, a source connected to the drain of the second P-channel MOS transistor and a drain connected to the output terminal.

An operation of the driver of FIG. 2 is explained next with reference to FIGS. 3A, 3B, 3C, 3D, 3E, 3F, 3G and 3H which show a two-data output period.

Figures 3A, 3B, 3C, 3D, 3E, 3F, 3G, 3H:
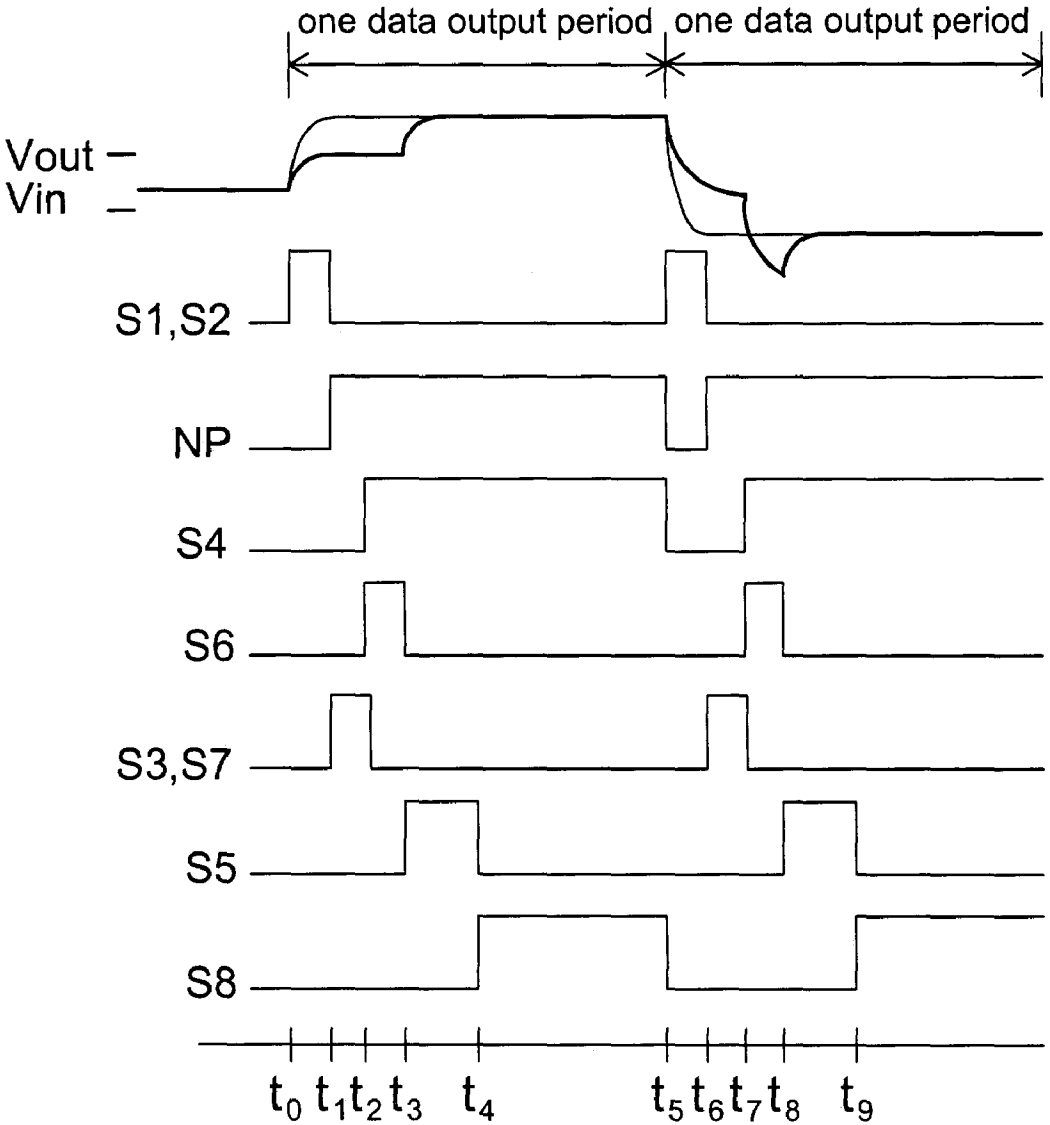
FIGS. 3A through 3H are timing diagrams for explaining an operation of the driver of FIG. 2 and FIG. 4.

First, at time t0, as shown in FIG. 3B, the switches S1 and S2 are both turned ON. A bias voltage $V_1$ at the gates of the transistors PT1 and PT2 is 0 volt. Also, a bias voltage $V_2$ at the gates of the transistors NT1 and NT2 is $V_{DD}-V_{thp4}$ volt.

Next, at time t1, as shown in FIGS. 3B and 3C, the switches S1 and S2 are turned OFF and the control signal NP is at ON state to boost the voltage of the drain of the first N-channel MOS transistor NT1 to a voltage higher than any predefined gamma voltage plus a threshold voltage of the N-channel MOS transistor. At the same time, the switch S3, S7 and the transistor PT4 (if PT4 and S7 exist) are turned ON, thus the bias voltage $V_1$ and $V_2$ become $$V_1=V_{in}-V_{thn3}+V_{thp1}$$

$$V_2=V_{in}+V_{thn1}+V_{thp4}$$

where $V_{thp1}$ is a threshold voltage of the transistor PT1, $V_{thn3}$ is a threshold voltage of the transistor NT3, $V_{thn1}$ is a threshold voltage of the transistor NT1 and $V_{thp4}$ is a threshold voltage of the transistor PT4

Next, at time t2, as shown in FIG. 3D, 3E, the switch S4 and S6 is turned ON, thus the bias voltage $V_2$ becomes $$V_2=V_{in}+V_{thn1}$$

In this state, since the transistor PT2 serves as a source follower, the output voltage $V_{out}$ becomes $$V_{out}=V_{in}-V_{thn3}+V_{thp1}-V_{thp2}$$

where $V_{thp2}$ is a threshold voltage of the transistor PT2.

Note that, the fourth P-channel MOS transistor PT4 and the seventh switch S7 are not an essential aspect of the present invention. If the fourth P-channel MOS transistor PT4 and the seventh switch S7 do not exist, the operation at time t1 and t2 will become a little different as followed. At the time t1, as shown in FIGS. 3C and 3F, the switch S3 is turned ON, thus the bias voltage $V_1$ becomes $$V_1=V_{in}-V_{thn3}+V_{thp1}$$

Next, at time t2, as shown in FIG. 3D, 3E, the switch S4 and S6 is turned ON, thus the bias voltage $V_2$ becomes $$V_2=V_{in}+V_{thn1}$$

In this state, since the transistor PT2 serves as a source follower, the output voltage $V_{out}$ becomes $$V_{out}=V_{in}-V_{thn3}+V_{thp1}-V_{thp2}$$

where $V_{thp2}$ is a threshold voltage of the transistor PT2.

The bias voltage $V_2$ is the same at time t2 with or without the fourth P-channel MOS transistor PT4 and the seventh switch S7. However, there has large current at the input terminal if the source driver of the present invention have not the fourth P-channel MOS transistor PT4 and the seventh switch 57. Therefore, if $V_{thp1}$ is similar to (≈) $V_{thp2}$, the output voltage $V_{out}$ is replaced by $$V_{out}\approx V_{in}-V_{thn3}$$

Note that, if the transistors PT1 and PT2 are formed closely to each other and their sizes are approximately the same as each other, the threshold voltages $V_{thp1}$ can be approximately the same as the threshold voltage $V_{thp2}$.

Next, at time t3, as shown in FIG. 3G, the switch S5 is turned ON. In this state, since the transistor NT2 serves as a source follower, the output voltage $V_{out}$ becomes $$V_{out}=V_{in}+V_{thn1}-V_{thn2}$$

where $V_{thn2}$ is a threshold voltage of the transistor NT2. Therefore, if $V_{thn1}$ is similar to (≈) $V_{thn2}$, the output voltage $V_{out}$ is replaced by $$V_{out}\approx V_{in}$$

Thus, in the first embodiment, the output voltage $V_{out}$ can be equal to the input voltage $V_{in}$, and a high accuracy voltage buffer by the transistor PT2 as a source follower combined with the transistor NT2.

Also note that, in the general N-well process, since the source follower of P-channel MOS transistor cannot trace the ultra-low Gamma voltage, it's better to put one more N-channel MOS transistor to pull to ground when the video data selects the ultra-low gamma voltage. The fourth N-channel MOS transistor NT4 is used to pull the output voltage to ground when the input voltage is smaller than the threshold voltage of the transistor PT2.

The operation of time t5 through time t8 are repeated the operation of time t0 through time t3.

Figure 4:
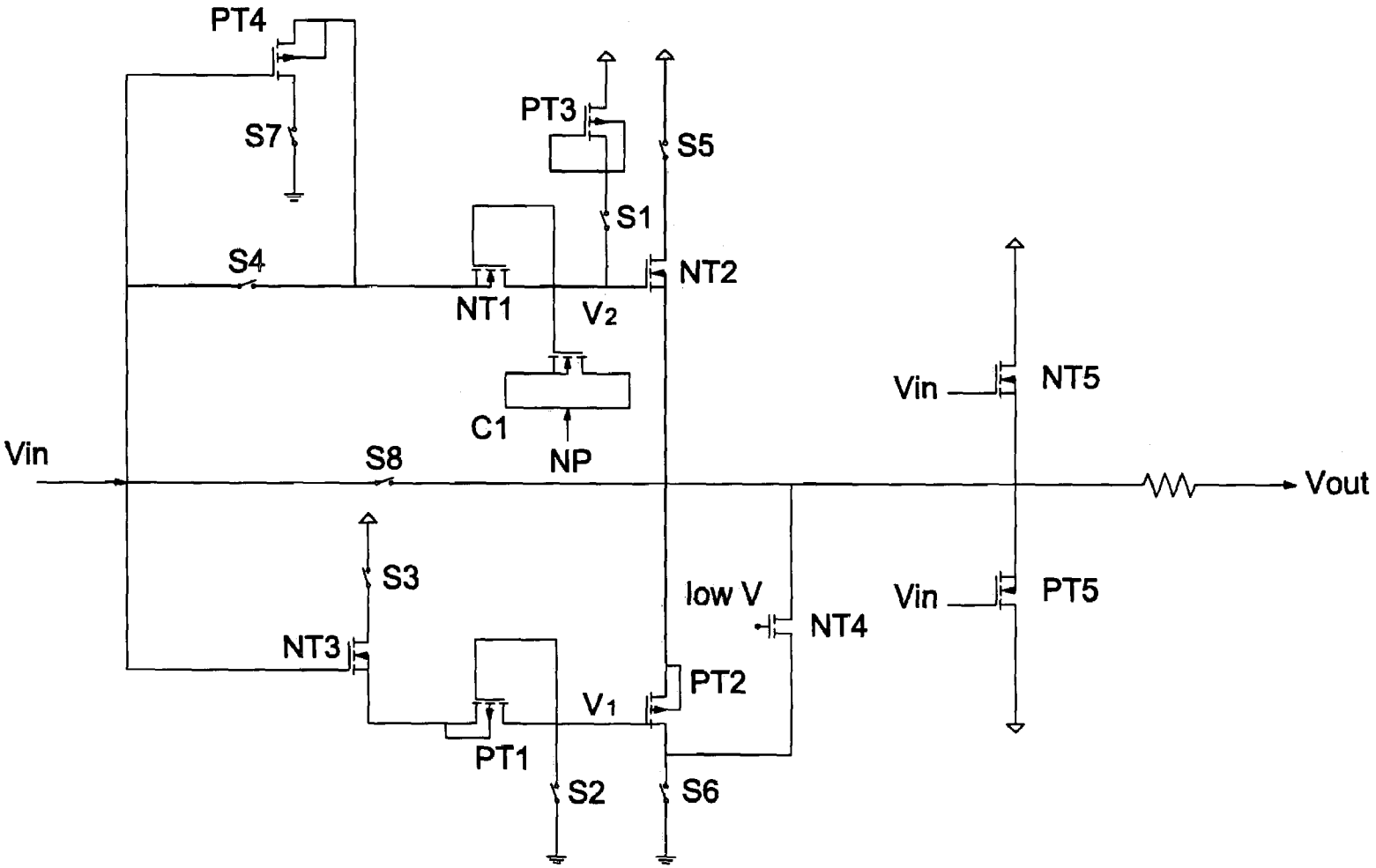
FIG. 4 is a circuit diagram of a modification of the driver of FIG. 2.

FIG. 4 shows a circuit diagram of a modification of the driver of FIG. 2. The source driver further comprises a eighth switch S8 connected between the input terminal and the output terminal. The eighth switch S8 is turned ON after operation of the second P-channel MOS transistor PT2 or the second N-channel MOS transistor NT2 as a source follower, as shown in FIG. 3H. Due to the poor driving capability of the source follower when $V_{out}$ is approaching $V_{in}$, the use of the eighth switch S8 can reach the accurate optimum value (target value). Another reason of using the switch S8 is to compensate for the difference between the output voltage $V_{out}$ and its optimum value due to the difference in threshold voltage between the transistors NT1 and NT2. For example, the operation of the driver of FIG. 4 is as shown in FIG. 3A through 3H. During a time period, from time t2 to time t4, the output voltage $V_{out}$ is represented by $$V_{out}=V_{in}+V_{thn1}-V_{thn2}$$

In this case, if there is a difference between $V_{thn1}$ and $V_{thn2}$, the output voltage $V_{out}$ deviates by ΔV from its optimum value, i.e., $V_{in}$. Next, at time t4, the switches S5 and S6 are both turned OFF and the switch S8 is turned ON, respectively, so that the output voltage $V_{out}$ will be averaged by source outputs with the same gray output voltage and will eventually become equal to the input voltage $V_{in}$ since ΔV is small if the time is long enough. Even the S8 period is not long, each source output with the same gray output can still be averaged, and the ΔV from it's optimum value can be offset cancelled by opposite polarity since the source output in the opposite polarity would be at the same order offset from it's optimum value. Thus, in FIG. 4, by turning on S8, the accuracy of the output voltage $V_{out}$ is enhanced. The source driver further comprises fifth N-channel MOS transistor NT5 and fifth P-channel MOS transistor PT5, the fifth N-channel MOS transistor NT5 having a source connected to the output terminal, a drain connected to the power supply terminal, a gate connected to the input terminal, the fifth P-channel MOS transistor PT5 having a source connected to the output terminal, a drain connected to the ground terminal, a gate connected to the input terminal. The fifth N-channel MOS transistor NT5 and fifth P-channel MOS transistor PT5 are used for charging and discharging source output for the first step to approach the target value. With the aid of the fifth N-channel MOS transistor NT5 and fifth P-channel MOS PT5, the source output can be operated more accurate.

FIG. 5 is a table showing the operation of the driver of FIG. 2. The operation of the driver as shown in FIG. 5 can be arranged easily by the logic circuit (not shown in FIG. 2).

Figure 6:
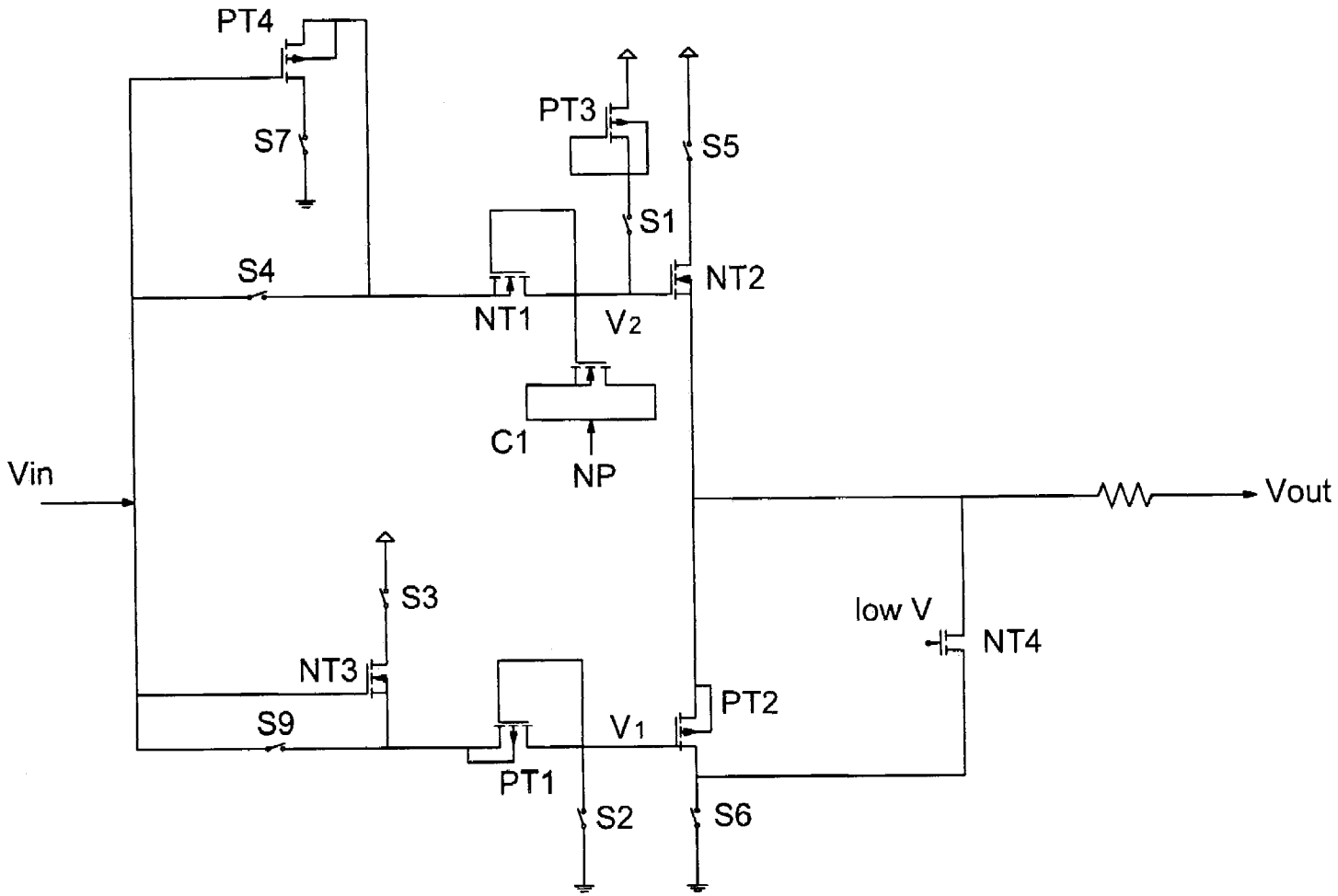
FIG. 6 is a circuit diagram illustrating a second embodiment of the driver according to the present invention.

FIG. 6 shows a source driver according to a second embodiment of the present invention. The structure of FIG. 6 is substantially identical to the structure of the FIG. 2. The main differences therebetween are set forth below. The fourth P-channel MOS transistor PT4 and the seventh switch S7 are necessary in the second embodiment of the source driver of the present invention. Furthermore, an eighth switch S8 is connected between the input terminal and the source of the first P-channel MOS transistor PT1.

Since the source follower of P-channel MOS transistor cannot trace the low Gamma voltage, there still needs the source follower of N-channel MOS transistor to trace the low Gamma voltage. For example, the V0 expresses the highest Gamma voltage, the V63 expresses the lowest Gamma voltage. The Gamma voltages of V1, V2, . . . V62 are decreased in sequence. The second embodiment of the driver according to the present invention separates the Gamma voltage into three parts. The Gamma voltages of part I are between V0 and V7. The Gamma voltages of part II are between V8 and V55. The Gamma voltages of part III are between V56 and V63.

FIGS. 7A through 7F show timing diagrams for explaining first operation of the driver of FIG. 6 in part I, which show a two-data output period. The switch S4 is always turned OFF in the part I and part II.

Figures 7A, 7B, 7C, 7D, 7E, 7F, 7G, 7H, 7I:
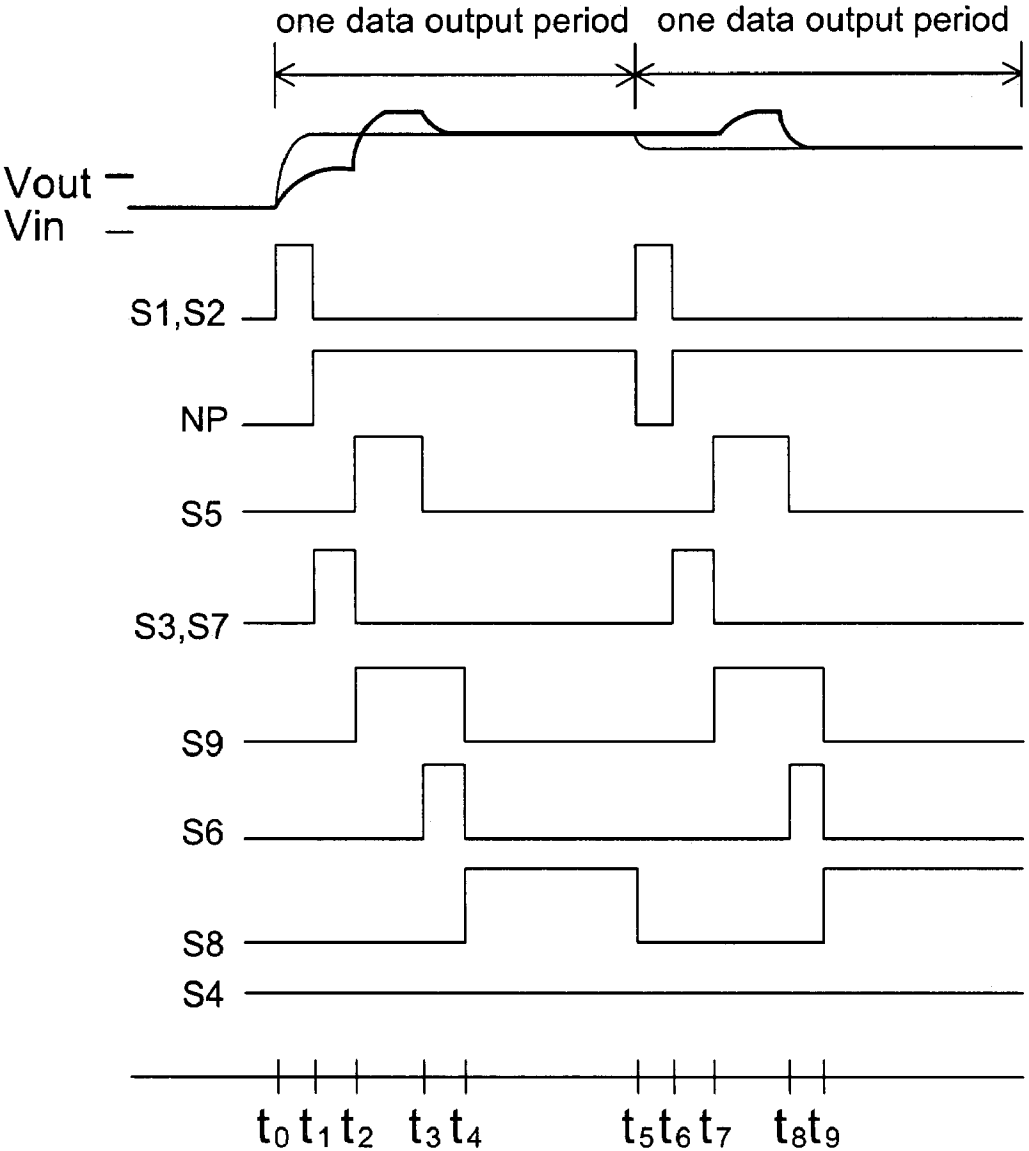
FIGS. 7A through 7I are timing diagrams for explaining a first operation of the driver of FIG. 6.

First, at time t0, as shown in FIG. 7B, the switches S1 and S2 are both turned ON. A bias voltage $V_1$ at the gates of the transistors PT1 and PT2 is 0 volt. Also, a bias voltage $V_2$ at the gates of the transistors NT1 and NT2 is $V_{DD}-V_{thp3}$ volt.

Next, at time t1, as shown in FIGS. 7B, 7C and 7E, the switches S1 and S2 are turned OFF and the switch S3 and S7 are turned on. In addition, the control signal NP is at ON state to boost the voltage of the drain of the first N-channel MOS transistor NT1 on the level of the input voltage plus the threshold voltage of the N-channel MOS transistor NT1 and the threshold voltage of P-channel MOS transistor PT4. At the time, the bias voltage $V_2$ becomes $$V_2=V_{in}+V_{thn1}-+V_{thp4}$$

Next, at time t2, as shown in FIG. 7F, the switches S3 and S7 are turned OFF and the switch S9 is turned on thus the bias voltage $V_1$ becomes $$V_1=V_{in}+V_{thp1}$$

In the meanwhile the switch S5 is turned ON. In this state, since the transistor NT2 serves as a source follower, the output voltage $V_{out}$ becomes $$V_{out}=V_{in}+V_{thn1}+V_{thp4}-V_{thn2}$$

Therefore, if $V_{thn1}$ is similar to (≈) $V_{thn2}$, the output voltage $V_{out}$ is replaced by $$V_{out}\approx V_{in}+V_{thp4}$$

Note that the maximum possible voltage level of ($V_{in}$+$V_{thp4}$) is power supply voltage.

Next, at time t3, as shown in FIGS. 7D and 7G, the switch S5 is turned OFF and the switch S6 is turned ON. In this state, since the transistor PT2 serves as a source follower, the output voltage $V_{out}$ becomes $$V_{out}=V_{in}+V_{thp1}-V_{thp2}$$

where $V_{thp2}$ is a threshold voltage of the transistor PT2. Therefore, if $V_{thp1}$ is similar to (≈) $V_{thp2}$, the output voltage $V_{out}$ is replaced by $$V_{out}\approx V_{in}$$

Note that, if the transistors PT1 and PT2 are formed closely to each other and their sizes are approximately the same as each other, the threshold voltages $V_{thp1}$ can be approximately the same as the threshold voltage $V_{thp2}$. Also note that, since in the general N-well process, the source follower of P-channel MOS transistor can not trace the ultra-low Gamma voltage, it's better to put one more N-channel MOS transistor to pull to ground when the video data selects to the ultra-low gamma voltage. The fourth N-channel MOS transistor NT4 is used to pull the output voltage to ground when the input voltage Vin is smaller than the threshold voltage of the transistor PT2. The operation of time t5 through time t8 are repeated the operation the operation of time to through time t3.

FIGS. 8A through 8F are timing diagrams for explaining a second operation of the driver of FIG. 6 in part II. The operations of the driver in part II is similar to the operations of the driver in part I except that the relation ($V_{in}$+$V_{thp4}$) during S5 turning on can be maintained, as shown in the FIGS. 7A and 8A.

FIGS. 9A through 9F are timing diagrams for explaining a third operation of the driver of FIG. 6 in part III. Since the Gamma voltages of part III between V56 and V63 are lower, the source follower of P-channel MOS transistor can not trace the low Gamma voltage exactly, the source follower of N-channel MOS transistor is used mainly to trace the low Gamma voltage. The switch S9 is always turned OFF in the part III.

Figures 9A, 9B, 9C, 9D, 9E, 9F, 9G, 9H, 9I:
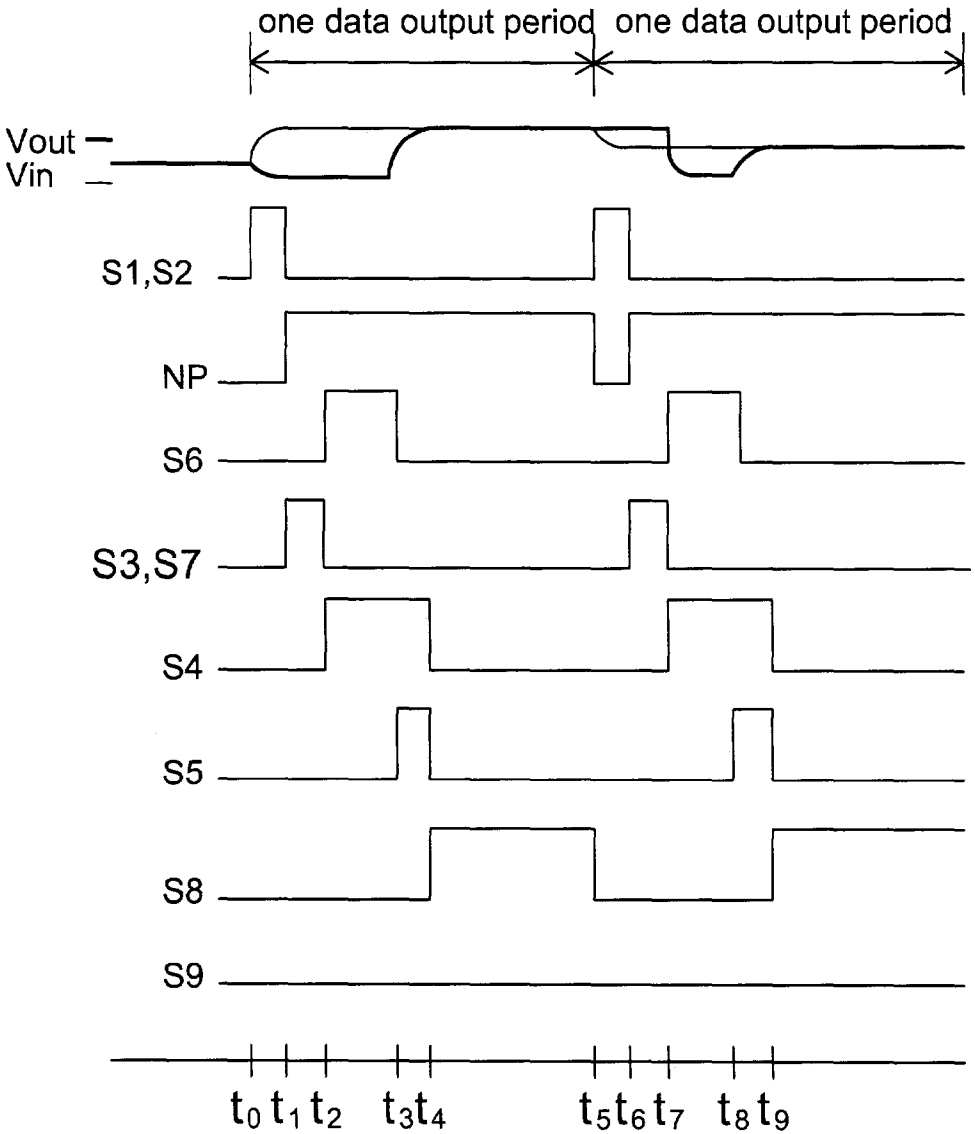
FIGS. 9A through 9I are timing diagrams for explaining a third operation of the driver of FIG. 6.

First, at time t0, as shown in FIG. 9B, the switches S1 and S2 are both turned ON. A bias voltage $V_1$ at the gates of the transistors PT1 and PT2 is 0 volt. Also, a bias voltage $V_2$ at the gates of the transistors NT1 and NT2 is $V_{DD}-V_{thp3}$ volt.

Next, at time t1, as shown in FIGS. 9B and 9C, the switches S1 and S2 are turned OFF and the switches S3 and S7 are turned on. In addition, the control signal NP is at ON state to boost the voltage of the drain of the first N-channel MOS transistor NT1 on the level of the input voltage plus the threshold voltage of the N-channel MOS transistor NT1 and the threshold voltage of the P-channel MOS transistor PT4.

Next, at time t2, as shown in FIGS. 9D and 9F, the switch S4 is turned ON and the bias voltage $V_1$ and $V_2$ become $$V_1=V_{in}++V_{thp1}-V_{thn3}$$

$$V_2=V_{in}+V_{thn1}$$

At the same time, the switch S6 is turned ON. In this state, since the transistor PT2 serves as a source follower, the output voltage $V_{out}$ becomes $$V_{out}=V_{in}+V_{thp1}-V_{thn3}-V_{thp2}$$

where $V_{thp2}$ is a threshold voltage of the transistor PT2. Therefore, if $V_{thp1}$ is similar to (≈) $V_{thp2}$, the output voltage $V_{out}$ is replaced by $$V_{out}\approx V_{in}-V_{thn3}$$

Note that, if the transistors PT1 and PT2 are formed closely to each other and their sizes are approximately the same as each other, the threshold voltages $V_{thp1}$ can be approximately the same as the threshold voltage $V_{thp2}$.

Next, at time t3, as shown in FIG. 9G, the switch S5 is turned ON. In this state, since the transistor NT2 serves as a source follower, the output voltage $V_{out}$ becomes $$V_{out}=V_{in}+V_{thn1}-V_{thn2}$$

where $V_{thn2}$ is a threshold voltage of the transistor NT2. Therefore, if $V_{thn1}$ is similar to (≈) $V_{thn2}$, the output voltage $V_{out}$ is replaced by $$V_{out}\approx V_{in}$$

Figures 8A, 8B, 8C, 8D, 8E, 8F, 8G, 8H, 8I:
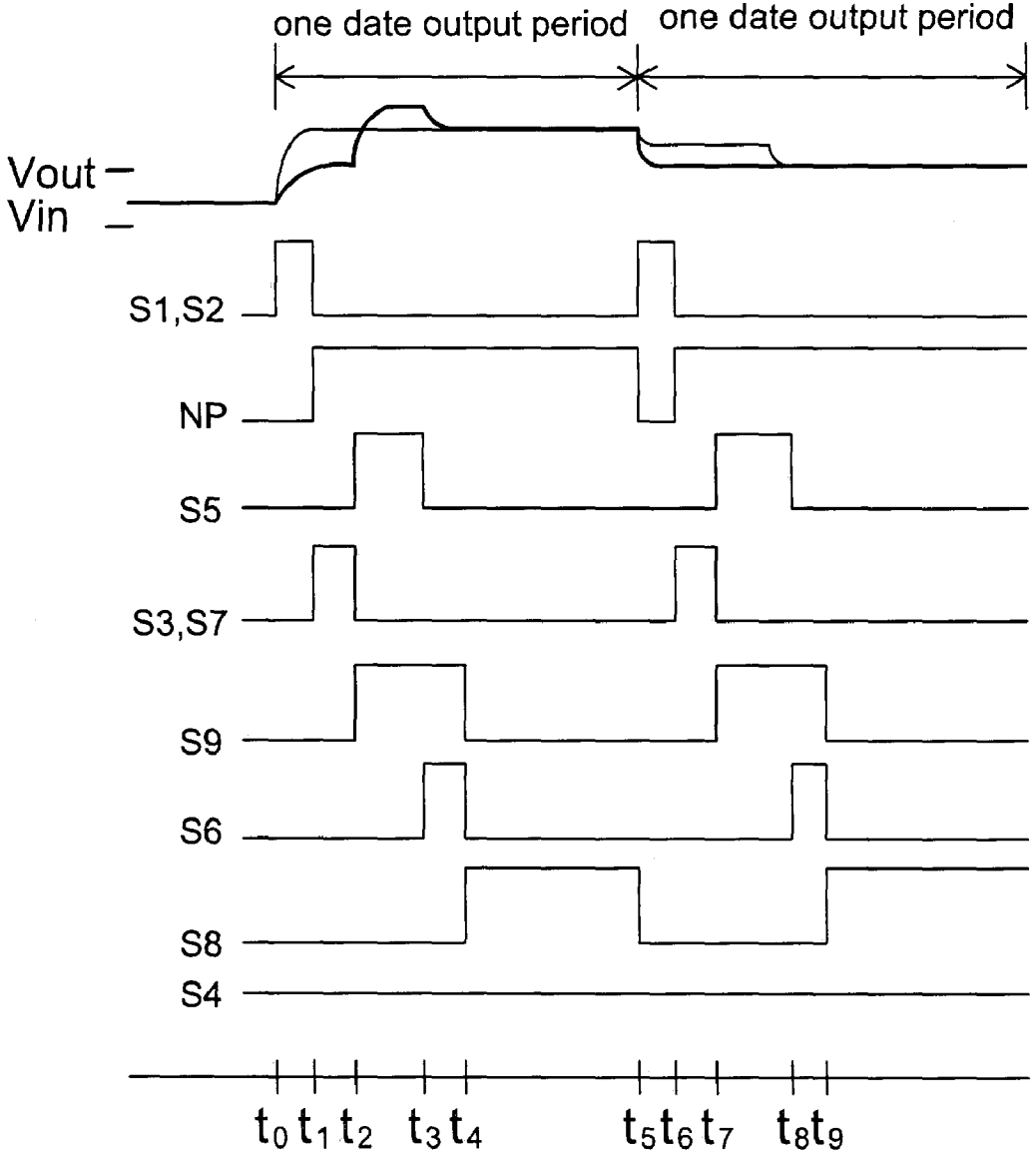
FIGS. 8A through 8I are timing diagrams for explaining a second operation of the driver of FIG. 6.
Figure 10:
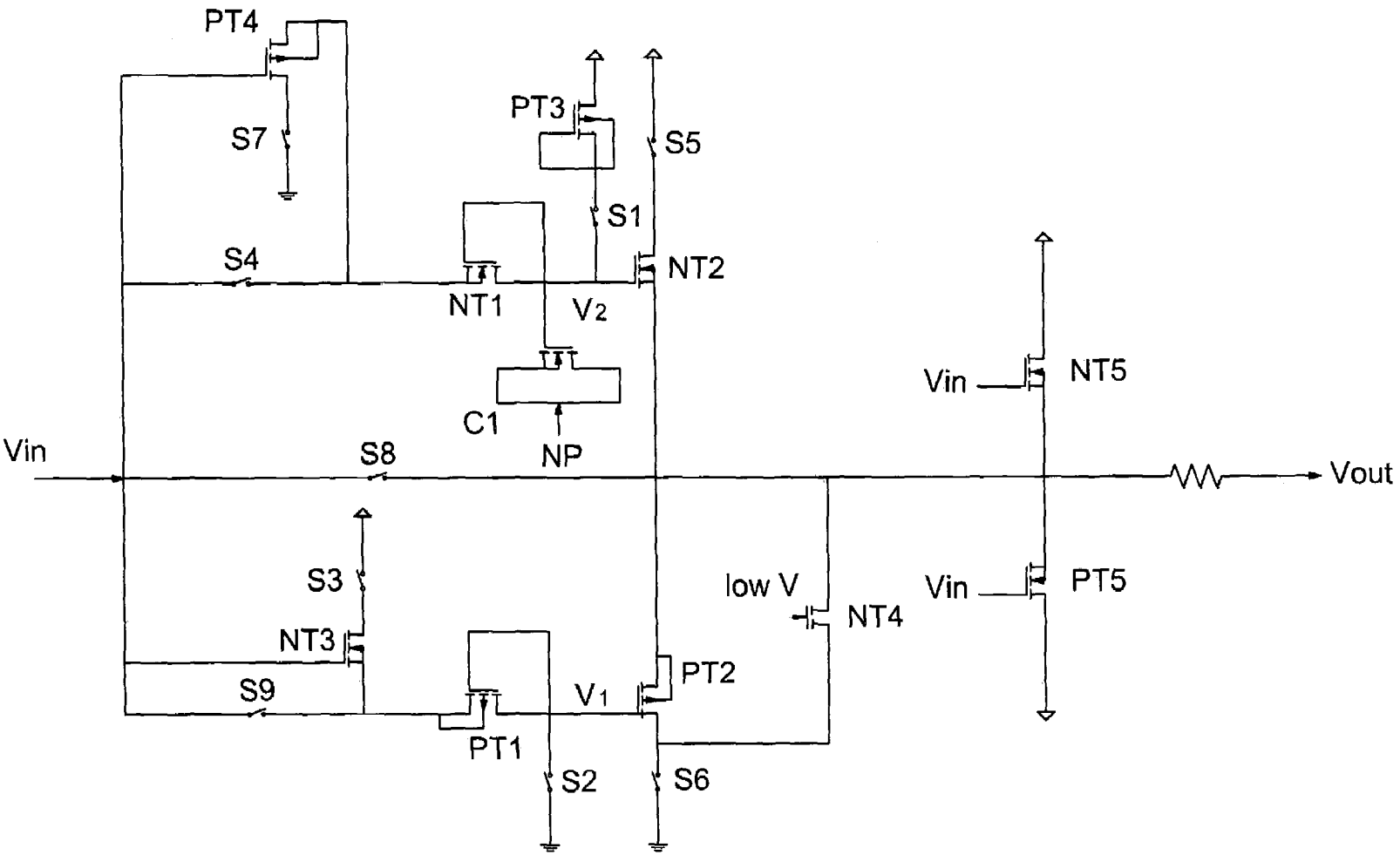
FIG. 10 is a circuit diagram of a modification of the driver of FIG. 6.

FIG. 10 shows a circuit diagram of modification of the drivers of FIG. 6. The source driver further comprises a eighth switch S8 connected between the input terminal and the output terminal. The eighth switch S8 is turned ON after operation of the second P-channel MOS transistor PT2 or the second N-channel MOS transistor NT2 as a source follower, as shown in FIGS. 7H, 8H and 9H. Due to the poor driving capability of the source follower when $V_{out}$ is approaching $V_{in}$, the use of switch S8 can reach the accurate optimum value (target value). Another reason of using the switch S8 is described in FIG. 4. The source driver further comprises a fifth N-channel MOS transistor NT5 and a fifth P-channel MOS transistor PT5. The fifth N-channel MOS transistor NT5 has a source connected to the output terminal, a drain connected to the power supply terminal, a gate connected to the input terminal. The fifth P-channel MOS transistor PT5 has a source connected to the output terminal, a drain connected to the ground terminal, a gate connected to the input terminal. The fifth N-channel MOS transistor and fifth P-channel MOS transistor are also used for more accurate output voltage.

FIG. 11 is a table showing the operation of the driver of FIG. 6. Although the operation of the driver is different from part I, II to part III, the operation of the driver as shown in FIG. 7–9 can still be arranged easily by the logic circuit.(not shown in Fig.) Namely, the switch between S5 and S6, or S4 and S8 in part I, II, III can be easily implemented by the multiplexer.

Thus, in the second embodiment, the output voltage $V_{out}$ can be equal to the input voltage $V_{in}$, and a high current supply capability by the transistor PT2 as a source follower combined with the transistor NT2 as a source follower can be exhibited.

In the above-mentioned embodiments, the P-channel MOS transistors can be other P-channel transistors of a gate insulation type, and the N-channel MOS transistors can be other N-channel transistors of a gate insulation type.

As explained hereinabove, according to the present invention, since the driver has no operational amplifier with a large number of elements and the novel driver circuit design according to the present invention applied to the LCD can adequately use the wafer IC process, the chip size of the driver can be reduced thereby lowering not only the manufacturing cost but also the power dissipation.

Although the invention has been explained in relation to its preferred embodiment, it is to be understood that many other possible modifications and variations can be made without departing from the spirit and scope of the invention as hereinafter claimed.

What is claimed is:

1. A source driver in a liquid crystal display apparatus for receiving an input voltage and generating an output voltage to drive a data line, comprising:

a ground terminal to which a ground voltage is applied;

a power supply terminal to which a power supply voltage higher than the ground voltage is applied;

an input terminal for receiving the input voltage;

an output terminal for generating the output voltage;

first and second P-channel MOS transistors each having a gate connected to a drain of the first P-channel MOS transistor, the second P-channel MOS transistor having a source connected to the output terminal;

first and second N-channel MOS transistors each having a gate connected to a drain of the first N-channel MOS transistor, the second N-channel MOS transistor having a source connected to the output terminal;

a third N-channel MOS transistor having a gate connected to the input terminal and a source connected to a source of the first P-channel MOS transistor;

a third P-channel MOS transistor having a drain connected to the power supply terminal, and a gate connected to a source of the third P-channel MOS transistor;

a first switch connected between the source of the third P-channel MOS transistor and the drain of the first N-channel MOS transistor;

a second switch connected between the ground terminal and the drain of the first P-channel MOS transistor;

a third switch connected between the power supply terminal and a drain of the third N-channel MOS transistor;

a fourth switch connected between the input terminal and a source of the first N-channel MOS transistor;

a fifth switch connected between the power supply terminal and a drain of the second N-channel MOS transistor;

a sixth switch connected between the ground terminal and a drain of the second-P-channel MOS transistor; and a first capacitor connected between a control signal terminal and the drain of the first N-channel MOS transistor.

2. The source driver as claimed in claim 1, wherein the first capacitor is operated to boost the voltage of the drain of the first N-channel MOS transistor on the level of at least the input voltage plus the threshold voltage of the N-channel MOS transistor at a predetermined time.

3. The source driver as claimed in claim 1, wherein the third and second switches are operated to bias the gate of the second P-channel MOS transistor a voltage of (Vin+Vthp1−Vthn3) at a predetermined time, Vin being the input voltage, Vthp1 being a threshold voltage of the first P-channel MOS transistor, Vthn3 being a threshold voltage of the third N-channel MOS transistor.

4. The source driver as claimed in claim 1, wherein the fourth and first switches are operated to bias the gate of the second N-channel MOS transistor a voltage of (Vin+Vthn1) at a predetermined time, Vin being the input voltage, Vthn1 being a threshold voltage of the first N-channel MOS transistor.

5. The source driver as claimed in claim 1, wherein the sixth switch is operated to operate the second P-channel MOS transistor as a source follower.

6. The source driver as claimed in claim 1, wherein the fifth switch is operated to operate the second N-channel MOS transistor as a source follower.

7. The source driver as claimed in claim 1, further comprising a fourth N-channel MOS transistor having a source connected to the drain of the second P-channel MOS transistor and a drain connected to the output terminal, wherein the fourth N-channel MOS transistor is used to substantially pull the output voltage to ground at predetermined time when the input voltage is smaller than the threshold voltage of the transistor.

8. The source driver as claimed in claim 1, further comprising:

a fourth P-channel MOS transistor having a gate connected to the input terminal and a source connected to the source of the first N-channel MOS transistor; and a seventh switch connected between the ground terminal and a drain of the fourth P-channel MOS transistor.

9. The source driver as claimed in claim 8, further comprising a ninth switch connected between the input terminal and a source of the third N-channel MOS transistor.

10. The source driver as claimed in claim 9, wherein while the fourth and ninth switches are kept turned OFF and ON respectively, and then the fifth and sixth switches are turned ON and OFF respectively, to operate the second N-channel MOS transistor as a source follower.

11. The source driver as claimed in claim 10, wherein after the fifth and sixth switches are turned ON and OFF respectively for a predetermined period, and then the fifth and sixth switches are turned OFF and ON respectively, to operate the second P-channel MOS transistor as a source follower.

12. The source driver as claimed in claim 9, wherein while the fourth and ninth switches are kept turned ON and OFF respectively, and then the fifth and sixth switches are turned OFF and ON respectively, to operate the second P-channel MOS transistor as a source follower.

13. The source driver as claimed in claim 12, wherein after the fifth and sixth switches are turned OFF and ON respectively for a predetermined period, and then the fifth and sixth switches are turned ON and OFF respectively, to operate the second N-channel MOS transistor as a source follower.

14. The source driver as claimed in claim 9, further comprising a eighth switch connected between the input terminal and the output terminal, the eighth switch being turned ON after operation of the second P-channel MOS transistor or the second N-channel MOS transistor as a source follower.

15. The source driver as claimed in claim 9, further comprising a fourth N-channel MOS transistor having a source connected to the drain of the second P-channel MOS transistor and a drain connected to the output terminal, wherein the fourth N-channel MOS transistor is used to substantially pull the output voltage to ground at predetermined time when the input voltage is smaller than the threshold voltage of the transistor.

16. The source driver as claimed in claim 9, further comprising a fifth N-channel MOS transistor and a fifth P-channel MOS transistor, wherein the fifth N-channel MOS transistor has a source connected to the output terminal, a drain connected to the power supply terminal, and a gate connected to the input terminal, and the fifth P-channel MOS transistor has a source connected to the output terminal, a drain connected to the ground terminal, and a gate connected to the input terminal.

17. The source driver as claimed in claim 1, wherein, after the gate of the second P-channel MOS transistor is biased on the voltage level of (Vin−Vthn3+Vthp1), the sixth and fifth switches are turned ON and OFF, respectively, to operate the second P-channel MOS transistor as a source follower Vin being the input voltage, Vthp1 being a threshold voltage of the first P-channel MOS transistor, Vthn3 being a threshold voltage of the third N-channel MOS transistor.

18. The source driver as claimed in claim 1, wherein, after the gate of the second N-channel MOS transistor is biased on the voltage level of (Vin+Vthn1), the sixth and fifth switches are turned OFF and ON, respectively, to operate the second N-channel MOS transistor as a source follower, Vin being the input voltage, Vthn1 being a threshold voltage of the first N-channel MOS transistor.

19. The source driver as claimed in claim 1, further comprising a eighth switch connected between the input terminal and the output terminal, the eighth switch being turned ON after operation of the second P-channel MOS transistor or the second N-channel MOS transistor as a source follower.

20. The source driver as claimed in claim 1, further comprising a fifth N-channel MOS transistor and a fifth P-channel MOS transistor, wherein the fifth N-channel MOS transistor has a source connected to the output terminal, a drain connected to the power supply terminal, and a gate connected to the input terminal, and the fifth P-channel MOS transistor has a source connected to the output terminal, a drain connected to the ground terminal, and a gate connected to the input terminal.

* * * * *